US005676755A

United States Patent [19]

Siemers et al.

[11] Patent Number: 5,676,755

[45] Date of Patent: Oct. 14, 1997

[54] FLUME COATER

[75] Inventors: David C. Siemers; Donald E. Miller; Larry J. Head; Jeffrey L. Dexter, all of Evansville, Ind.

[73] Assignee: George Koch Sons, Inc., Evansville, Ind.

[21] Appl. No.: 491,037

[22] Filed: Jun. 16, 1995

[51] Int. Cl.[6] ..... B05C 3/02

[52] U.S. Cl. ..... 118/404; 118/66; 118/305; 118/314; 118/315; 118/324; 118/400; 118/407; 118/410; 118/423

[58] Field of Search ..... 118/66, 305, 314, 118/315, 324, 404, 407, 400, 410, 423

[56] References Cited

U.S. PATENT DOCUMENTS 4,663,197 5/1987 Bok ..... 118/314

4,794,018 12/1988 Scheetz ..... 118/407

*Primary Examiner*—Donald E. Czaja

*Assistant Examiner*—Michael P. Colaianni

*Attorney, Agent, or Firm*—Barnes & Thornburg

[57] ABSTRACT

A coater is provided for coating objects with a liquid material. The coater includes a flume that has an entry and an exit end, a supply of liquid coating material upon which the objects float, and a circulation system. The circulation system delivers the liquid material to the entry end of the flume so that the liquid material flows toward and out the exit end. The coater also includes a conveyor that loads the objects into the flume and a conveyor that receives the objects at the exit end of the flume.

34 Claims, 2 Drawing Sheets

FLUME COATER

BACKGROUND AND SUMMARY OF THE INVENTION

The present invention relates to a system for coating elongated objects such as linear pieces of wood or other objects and more particularly to the provision of a coating system utilizing a flume for conveying objects to be coated in a liquid coating material from the entry end of the flume to the exit end of the flume. Venturi nozzles are provided in a receiver for the objects at the entry end of the flume for propelling the objects toward the exit end of the flume and for coating the elongated objects with the coating material. Additional spray nozzles may be located throughout the flume, preferably in its cover, to spray coating material downwardly on the objects which are at least partially submerged in the coating material.

Linear wood products such as window and door moldings are treated with liquid preservative coatings to enhance their resistance to a variety of damaging conditions such as weather damage and wood damage by organisms. This type of coating is commonly carried out using batch dip processes in which the linear wood products are placed in racks or fixtures and dipped into a vat or tank containing liquid preservative coating. The products are submerged in the liquid preservative coating for a predetermined period of time. The racks or fixtures are then removed from the vat and excess liquid preservative coating is allowed to drain from the product. Another method involves conveying such linear pieces of wood on mechanical conveyors into and out of a vat or tank of liquid preservative coating. Both of these processes require the use of large vats of liquid preservative coating in order to accomplish the treatment of large volumes of linear wood product. These large treating vats have large surface areas of wood preservative coatings exposed to surrounding air which results in excessive evaporation and, in the case of many coatings, the excessive release of Volatile Organic Compounds (VOC's) to the atmosphere. The use of "batch" processing, i.e., the dipping of racks or fixtures into preservative tanks, requires considerable material handling time to load and unload the racks for the sole purpose of treating the product. This is rather inefficient and expensive. The use of mechanical conveyor systems for conveying individual pieces through such vats or tanks requires complicated systems for altering the conveyor to accommodate different cross-sectional shapes and lengths of product. The time required to change the settings for a conveyorized system also results in excessive loss of production time.

A need exists, therefore, for a method of applying wood preservative coating to linear wood product wherein the process can be carried out on a continuous basis, eliminating batch processing and also reducing the volume of preservative coating necessary for the process. A desirable system will reduce the exposed surface area of preservative coatings to reduce the evaporation loss.

It is, therefore, an object of the present invention to provide an improved method for applying wood preservative to linear wood pieces, such as window and door moldings. It is also an object of the present invention to provide an improved method for applying coating to any type of elongated object, wood or any other material.

It is another object of the present invention to allow for continuous processing of such elongated objects without the use of racks and fixtures for dipping, thereby reducing the material handling effort involved in typical batch processing.

It is another object of the present invention to eliminate the need for mechanical conveyors for conveying individual objects, such as elongated pieces of wood, through a vat of liquid coating material, thereby reducing the maintenance and set-up requirements of conventional conveyorized dipping systems.

It is an object of the present invention to provide a coater for objects comprising a flume having an entry end and an exit end with a supply of liquid coating material for the objects and a circulation system for delivering the material to the entry end so that it will flow toward and out the exit end. The circulation system establishes a level of liquid material in the flume for conveying and coating the objects. First means for conveying objects to the entry end of the conveyor is provided for depositing the objects for movement with such material through the flume and second means is provided for conveying objects away from the exit end of the flume after they are coated. A plurality of spray nozzles may be used within the flume, preferably in the roof or cover for the flume, for applying liquid coating material to such objects in the flume as they move from the entry end to the exit end. Typically, the objects to be coated will be at least partially submerged in the coating material in the flume such that the portions of the objects above the liquid level will be coated with the spray.

Another object of the present invention is to provide a receiver for such objects at the entry end of the flume, the receiver having a plurality of jets arranged to spray coating material on the objects and to propel the objects toward the exit end of the flume. These jets may be high volume, high velocity jets and the volume and pressure of the liquid delivered to the jets may be adjusted.

Still another object of the present invention is to provide a coater for elongated objects such as elongated pieces of wood or other such elongated pieces to be coated with a liquid coating material, the coater comprising an elongated trough providing a flume having an entry end for receiving the coating material and an exit end from which the coating material drains. A circulation system is provided for depositing the liquid material in the entry end to flow toward and out of the exit end. A first conveyor is provided for loading such objects into the flume with the objects extending generally in the longitudinal direction of the flume, and a second conveyor is provided for receiving such objects after they are coated and carrying them away from the exit end of the flume. The coater is preferably provided with a receiver for such objects at the entry end of the flume, the receiver comprising a plurality of venturi nozzles for spraying such liquid coating on the objects and propelling the objects toward the exit end of the flume.

Still another object of the present invention is to provide an elongated flume coater for elongated objects such as elongated pieces of wood or other such pieces to be coated with a liquid coating material, the coater comprising an elongated flume for receiving liquid coating material and conveying it from an entry end of the flume to an exit end of the flume. The objects to be coated are placed in the flume. A circulation system for conveying liquid coating material to the entry end of the flume is provided to establish a level of material therein with the objects being at least partially submerged in the material as they move through the flume.

Yet another object of the present invention is to provide a method for coating elongated objects such as pieces of wood or other elongated objects comprising the steps of providing an elongated flume having an entry end and an exit end with a quantity of liquid coating material flowing from the entry end to the exit end to convey and coat such objects, placing such objects in the entry end to extend longitudinally in the direction of the elongation of the flume with the objects at least partially submerged in the material, and removing the objects from the exit end of the flume. The method preferably includes the steps of spraying material from above the material flowing in the flume to apply the material to the unsubmerged portions of the objects. The method also preferably includes providing a plurality of venturi nozzles at the entry end of the flume to coat the elongated pieces and to propel the pieces into the flume and toward the exit end of the flume.

Other objects and features of the present invention will become apparent as this description progresses.

BRIEF DESCRIPTION OF THE DRAWINGS

The detailed description particularly refers to the accompanying figures in which.

DETAILED DESCRIPTION OF THE DRAWINGS

Figure 1:
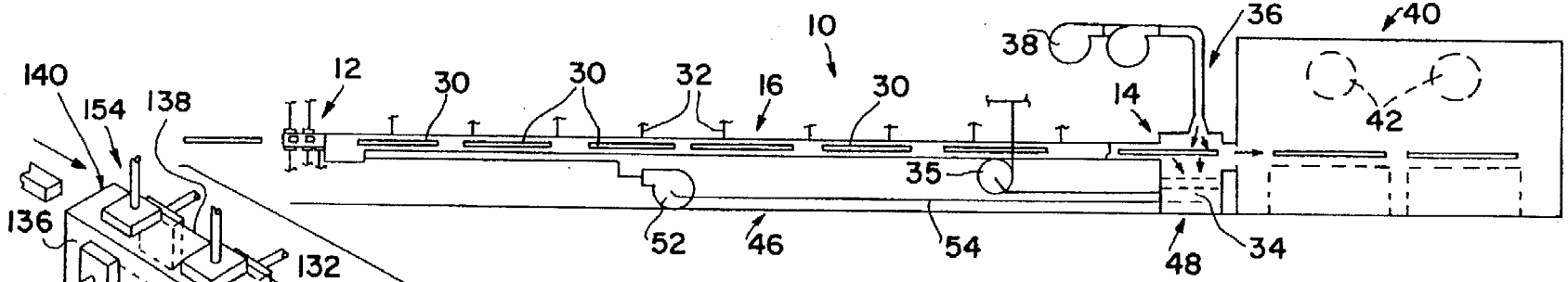
FIG. 1 is a sectional view, partially cut away, showing diagrammatically the flume coater of the present invention.
Figure 2:
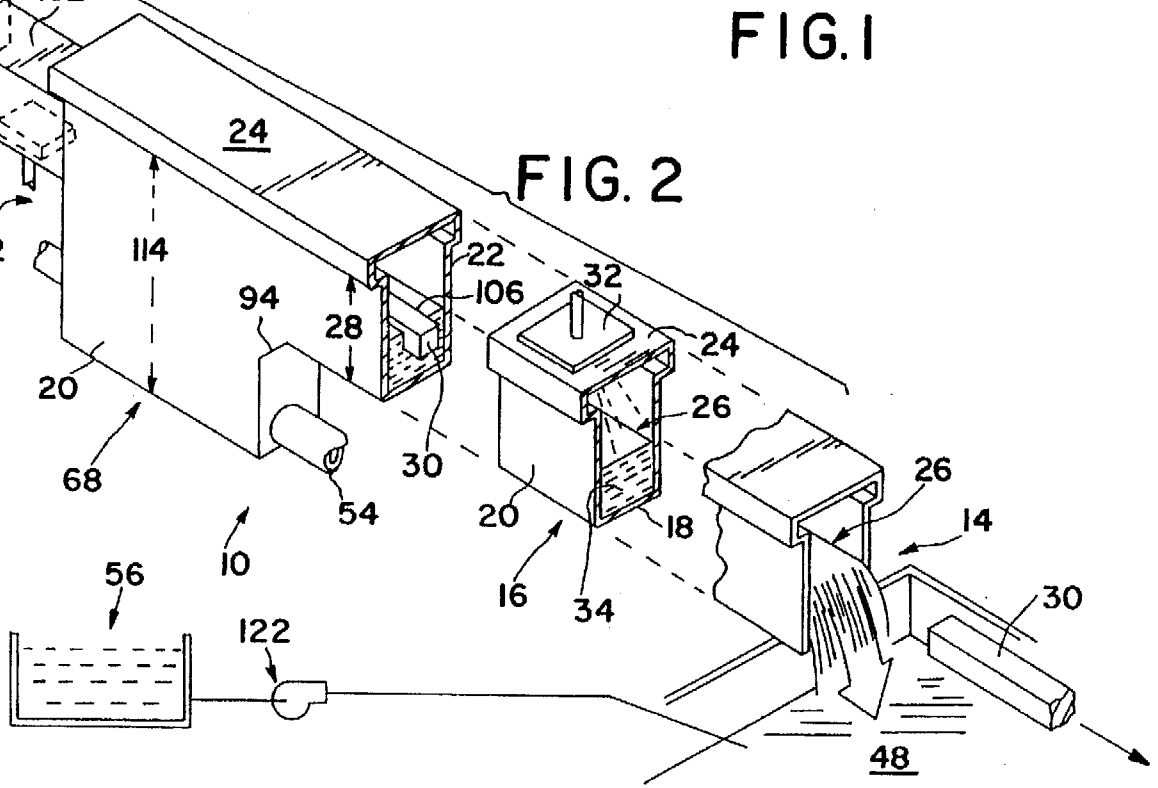
FIG. 2 is a partial perspective view showing segments of the flume coater of the present invention.

Referring now to the drawings, FIG. 1 and FIG. 2 illustrate a flume coater 10 including an entry end 12, an exit end 14, and a flume or flume section 16. As viewed in FIG. 2, the flume section 16 is designed to include a floor 18, a left side wall 20, a right side wall 22, and a cover 24 each connected to the other in a water-tight configuration to define an elongated rectangular passageway 26. The side walls 20 and 22 are designed to provide a flume height 28 (FIG. 4) in the passageway 26 that is sufficient to allow wood pieces 30 to travel through the passageway 26. Additionally, the cover 24 and floor 18 are constructed to define a flume width 29 (FIG. 4) that is also sufficient to allow wood pieces 30 to travel through the passageway 26.

In a preferred embodiment, spray nozzle assemblies 32 are mounted on the cover 24 to spray a liquid coating material 34 downwardly onto wood pieces 30 travelling through the flume section 16. A material spray pump 35 is configured to pump the liquid material 34 onto the wood pieces 30. In addition, a stripping section 36 extends from the exit end 14 of the coater 10 and typically includes blowers 38 to blow-off excess coating material 34 after the wood pieces 30 have travelled through the flume coater 10. Finally, a drying section 40 adjacent or downstream from the stripping section 36 provides dryers 42 to promote drying of the coating material 34 on the wood pieces 30.

Figure 3:
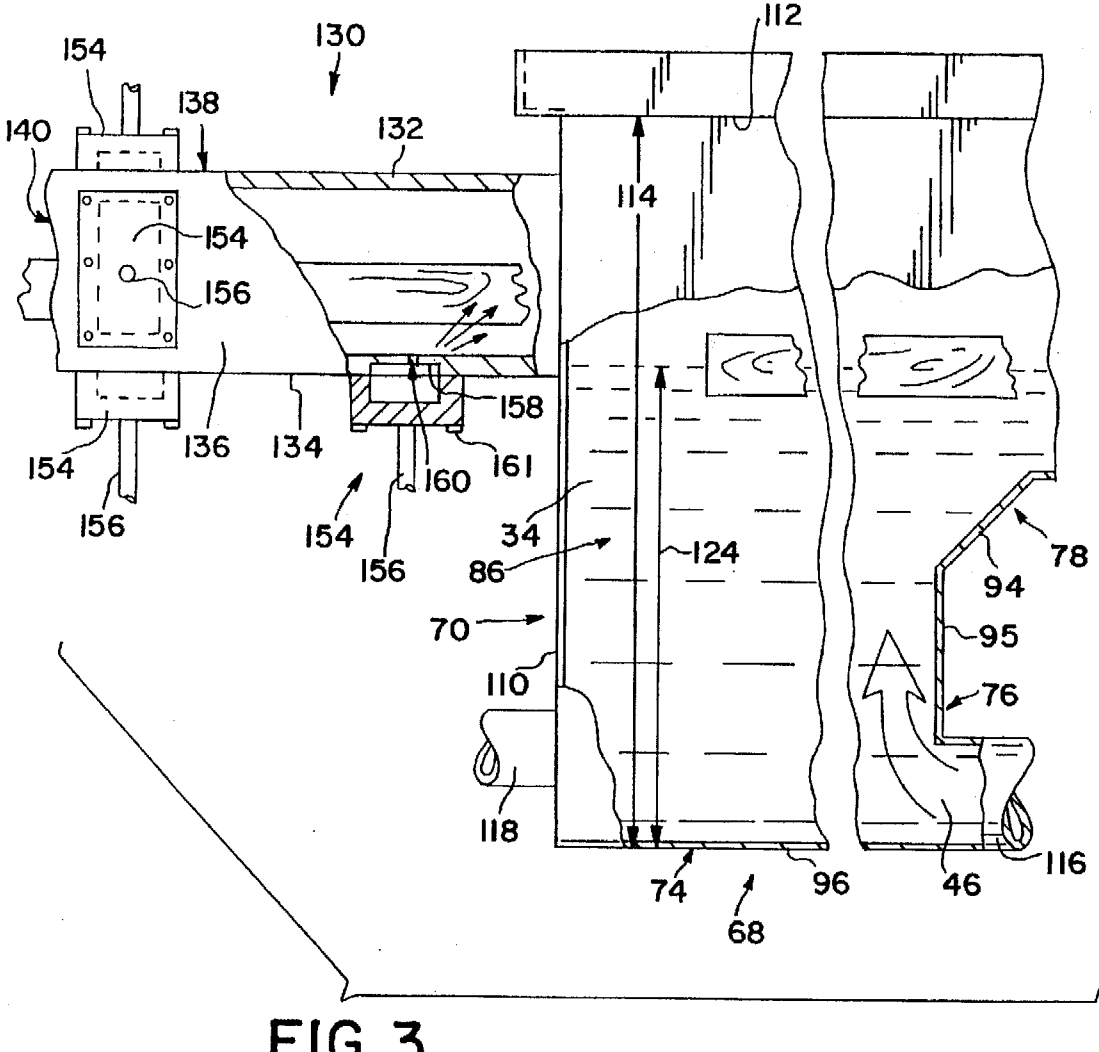
FIG. 3 is a fragmentary sectional view showing the entry end of the flume coater of the present invention with the receiver for receiving the objects and propelling the objects into the flume.

In the preferred embodiment, as illustrated in FIGS. 1–3, the flume coater 10 also includes a circulation system 46 to recirculate the coating material 34 used in the coating process. The circulation system 46 comprises a primary reservoir 48 connected to the exit end 14 of the coater 10 for capturing the coating material 34 that drains from the exit end 14. The circulation system 46 also comprises a recirculation pump 52 connected to the primary reservoir 48 and to the entry end 12 of the coater 10 to provide a recirculation path 54 for the coating material 34 to travel. The illustrative circulation system 46 includes a make-up tank 56 connected to the primary reservoir 48 for providing supplemental coating material 34 to the primary reservoir 48 to replace the coating material 34 that is absorbed by the wood pieces 30 or evaporated during the coating process. Advantageously, this recirculation method of applying wood preservative coating to linear wood product wherein the process can be carried out on a continuous basis, eliminates batch processing and also reduces the volume of preservative coating necessary for the process. It will be appreciated that a wide variety of pumps, valves, reservoirs, controllers, etc. may be used in a liquid circulation system for circulating coating material as required for operation of the coater 10 in accordance with the present invention. The capacity of the circulation system and particularly the pumps that cause the material to spray on the wood pieces are well within the capabilities of engineers and may be selected from commercially available equipment to meet the circulation and spraying objectives for a particular application.

In the preferred embodiment, as illustrated in FIG. 2 and FIG. 3, the flume coater 10 comprises a pool section 68 extending between the entry end 12 and the flume section 16. The illustrative pool section 68 includes a vertical entry wall panel 70, a bottom panel 74, a vertical inner wall panel 76, and an angularly oriented panel 78 that are connected to the side walls 20 and 22 in a water-tight configuration to define a deep elongated rectangular passageway 86 for receiving the wood pieces 30 at the entry end 12 of the coater 10. The side walls 20 and 22 are configured to extend to the left as viewed in FIG. 3 from the flume section 16 such that the walls 20 and 22 provide a downwardly ramping surface 94 on which to mount the angularly oriented panel 78, an inner vertical surface 95 on which to mount the vertical inner wall panel 76, a base surface 96 on which to mount the bottom panel 74, an outer vertical surface 110 on which to mount the vertical entry wall panel 70, and a top surface 112 on which to mount the cover 24. The panels (70, 74, 76, and 78) and cover 24, after being mounted to the side walls' 20 and 22 surfaces (94, 95, 96, 110, and 112), are then connected to the surfaces in a water-tight configuration to define a pool depth 114 and to prevent the liquid material 34 from escaping the flume coater 10.

However, the vertical inner wall panel 76 and the vertical entry wall panel 70 include first and second openings 116 and 118, respectively, for receiving the liquid material 34 from the circulation system 46. The vertical inner wall panel 76 includes a first opening 116 for receiving the liquid material 34 from the circulation system 46. The vertical entry wall 70 includes a second opening 118 for receiving the liquid material 34 from the reservoir 48. An alternative pumping system 122 pumps additional liquid 34 from the make-up tank 56 into the reservoir 48. The connection between the openings 116 and 118 and the panels 70 and 76 are water-tight and should not allow any significant liquid material 34 leakage.

Figure 4:
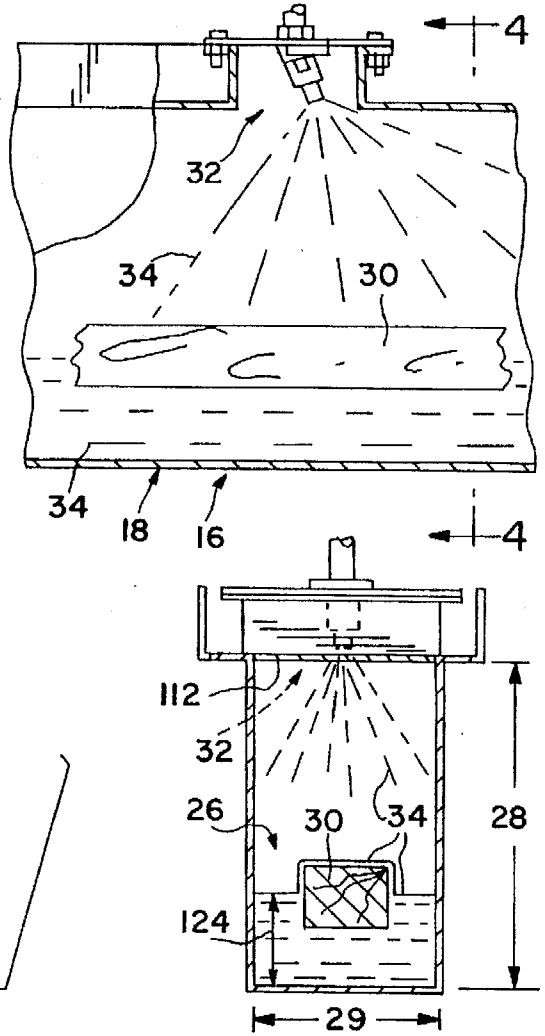
FIG. 4 is a sectional view taken along the lines 4—4 of FIG. 3.

As illustrated in FIG. 3 and FIG. 4, when the pool section 68 is connected and liquid material 34 is pumped into the pool section 68 through the first opening 116 or the second opening 118 via the circulation system 46, a level 124 of liquid material 34 is established that is sufficient to allow the wood pieces 30 to float through the rectangular passageways 26 and 86 so that the pieces 30 can be coated. In addition, the spray nozzle assemblies 32 extending through the cover 24 spray the liquid material 34 onto the wood pieces 30 during the coating process. Therefore, the wood pieces 30 are continuously coated with liquid coating material 34 as the pieces 30 travel through the coater 10. The movement of the liquid from the pool section 68 through the flume section 16, of course, carries the wood pieces from the entry end 12 to the exit end 14 of the coater 10.

In the preferred embodiment, the coater 10 includes a receiver 130 connected to the entry end 12 of the coater 10 to coat and propel the wood pieces 30 after the wood pieces 30 have been received from another conveyor or process (not shown). Details of the structure and function of the receiver are illustrated in FIG. 2 and FIG. 3. FIGS. 2 and 3 illustrate that the receiver 130 includes an upper wall 132, a lower wall 134, a front side wall 136, and a back side wall 138 connected to one another in such a manner as to define an elongated receiver passageway 140. Like the passageways 26 and 86 in the flume section 16 and pool section 68, respectively, the receiver passageway 140 is designed to be sufficiently high and wide to allow the wood pieces 30 to travel through the receiver 130.

The illustrative receiver 130 also includes two spray jet assemblies 154 mounted to each of the side walls 136 and 138 and to the upper wall 132, but includes three spray jet assemblies 154 mounted to the lower wall 134. FIG. 3 illustrates the function of the spray jet assemblies 154 by depicting a pipe 156 that supplies liquid material 34 under pressure created by the material spray pump 35 to the spray jet assemblies 154. Each of the spray jet assemblies 154 include a plate assembly 158 that contains a plurality of orifices 160. The liquid material 34 is pumped through the orifices 160 at an appropriate angle and at an appropriate pressure to propel the wood pieces 30 toward the exit end 14 of the flume coater 10. As illustrated in FIG. 3, plate assemblies 158 with screws 161 are configured to secure the spray jet assemblies 154 to the receiver 130. Advantageously, this receiver 130 provides additional coating capabilities while also providing a mechanism for receiving the wood pieces from another conveyor or process.

Although the invention has been described in detail with reference to certain preferred embodiments, variations and modifications exist within the scope and spirit of the invention as described and defined in the following claims.

We claim:

1. A coater for objects comprising:

a flume having an entry end and an exit end;

a supply of liquid coating material upon which the objects float and a circulation system for delivering the liquid material to the entry end so that the liquid material will flow toward and out the exit end, the circulation system establishing a level of liquid material in the flume for conveying and coating such objects;

first means for conveying objects to the entry end to deposit them for movement with the liquid coating material through the flume; and second means for conveying objects away from the exit end.

2. The coater of claim 1, further comprising at least one spray nozzle for applying liquid coating material to the objects in the flume as they move from the entry end to the exit end.

3. The coater of claim 2, further comprising a cover for the flume, the spray nozzle extending through the cover to spray downwardly on the objects.

4. The coater of claim 1, further comprising a stripping station connected to the exit end to strip the excess coating material from the objects being coated.

5. The coater of claim 4, further comprising a drying station extending from the stripping section to sufficiently dry the objects.

6. The coater of claim 1, further comprising a receiver for receiving the objects at the entry end of the flume, the receiver having at least one spray jet arranged to spray coating material on the objects and to propel the objects toward the exit end of the flume.

7. The coater of claim 6, wherein the receiver includes an upper wall, a lower wall, a front side wall and a back side wall connected to define a rectangular path for receiving the objects and passing the objects into the flume.

8. The coater of claim 6, further comprising a cover for the flume having at least one spray nozzle extending through the cover to spray the coating material downwardly on the objects.

9. The coater of claim 8, further comprising a stripping station connected to the exit end to strip the excess material from the objects being coated.

10. The coater of claim 9, further comprising a drying station extending from the stripping section to sufficiently dry the objects.

11. The coater of claim 7, further comprising at least one spray jet on each of the upper wall, lower wall and side walls.

12. The coater of claim 7, wherein each spray jet in the receiver is pointed inwardly and toward the exit end of the flume to propel such objects in that direction.

13. A coater for elongated objects to be coated with a liquid coating material, the coater comprising:

an elongated trough providing a flume having an entry end for receiving the coating material and an exit end from which the coating material drains;

a circulation system for depositing the liquid material in the entry end to flow toward and out the exit end so that the objects float in the liquid material between the entry end and the exit end and are coated as they float;

a first conveyor for loading the objects into the flume with the objects extending generally in the longitudinal direction of the flume; and a second conveyor for receiving the objects and carrying them away from the exit end of the flume.

14. The coater of claim 13, further comprising a receiver for the objects at the entry end of the flume, the receiver comprising at least one spray jet assembly for spraying the liquid coating onto the objects and propelling the objects toward the entry end of the flume and a means for supplying the coating material to the spray jet assembly.

15. The coater of claim 14, wherein the spray jet assembly includes an orifice plate connected to the receiver for directing a flow of the material at a prescribed angle to propel the object into the entry end of the flume.

16. The coater of claim 15, wherein the means for supplying the coating material provides a variable flow rate and pressure for defining an ample amount of inertia imparted to the object to prevent a backflow of material from the flume.

17. The coater of claim 16, wherein the receiver includes an upper wall, a lower wall, a front side wall and a back side wall connected to define a rectangular path for receiving the elongated objects and passing the objects into the flume.

18. The coater of claim 17, wherein a pair of first spray jet assemblies longitudinally spaced apart from each other are connected to the upper wall, a pair of second spray jet assemblies longitudinally spaced apart from each other are connected to each side wall, and three spray jet assemblies longitudinally spaced apart from each other are connected to the lower wall.

19. The coater of claim 18, further comprising a stripping station connected to the exit end of the flume to strip the excess material from the objects being coated.

20. The coater of claim 19, further comprising a drying station extending from the stripping station to sufficiently dry the objects.

21. An elongated flume coater for elongated objects to be coated with a liquid coating material, the coater comprising:

an elongated flume for receiving the liquid coating material and conveying it from an entry end of the flume to an exit end of the flume;

a circulation system for conveying liquid coating material to the entry end of the flume to establish a level of material therein with the objects floating in the material as they move through the flume; and the objects being movable longitudinally through the flume from the entry end to the exit end to be coated with the material.

22. The coater of claim 21, further comprising a cover for the flume having at least one spray nozzle extending through the cover to spray the coating material downwardly on the objects.

23. The coater of claim 22, further comprising a receiver for the objects at the entry end of the flume, the receiver comprising at least one spray jet assembly including an orifice plate for directing a flow of the material at a prescribed angle to coat the object and propel the object into the entry end of the flume.

24. The coater of claim 23, wherein the entry end of the flume provides a pool area for receiving a sufficient amount of the liquid coating material to maintain a level of the liquid material allowing the elongated objects to travel through the flume.

25. The coater of claim 24, further comprising at least one reservoir connected by pipes and pumps to supply the liquid coating material to the circulation system, the spray nozzles, and the spray jets.

26. The coater of claim 25, wherein at least one reservoir is connected to the exit end of the flume to capture the liquid material draining out of the end of the flume for recirculation.

27. A coater for coating objects with a liquid coating material, the objects having a density below that of the liquid coating material, the coater comprising:

a flume having an entry end, an exit end, and an interior region therebetween; and a circulation system for delivering liquid coating material to the entry end and removing liquid coating material from the exit end so that liquid coating material flows from the entry end to the exit end and maintain a sufficient level of liquid coating material in the interior region so that the objects float in the liquid coating material and are transported by the liquid coating material from the entry end to the exit end as the objects are coated by the liquid coating material.

28. The coater of claim 27, further comprising a receiver for receiving the objects at the entry end of the flume, the receiver having at least one spray jet arranged to spray coating material on the objects and to propel the objects toward the exit end of the flume.

29. The coater of claim 28, wherein the receiver includes an upper wall, a lower wall, a front side wall and a back side wall connected to define a rectangular path for receiving the objects and passing the objects into the flume.

30. The coater of claim 29, further comprising at least one spray jet on each of the upper wall, lower wall and side walls.

31. The coater of claim 29, wherein each spray jet in the receiver is pointed inwardly and toward the exit end of the flume to propel the objects in that direction.

32. The coater of claim 28, further comprising a cover for the flume having at least one spray nozzle extending through the cover to spray the coating material downwardly on the objects.

33. The coater of claim 27, further comprising at least one spray nozzle for applying liquid coating material to the objects in the flume as they move from the entry end to the exit end.

34. The coater of claim 33, further comprising a cover for the flume, the spray nozzle extending through the cover to spray downwardly on the objects.

* * * * *